US012433400B2

(12) United States Patent
Hanlon

(10) Patent No.: US 12,433,400 B2
(45) Date of Patent: Oct. 7, 2025

(54) COLLAPSIBLE AND EXPANDABLE STORAGE RACK

(71) Applicant: Perfect Site, LLC, Las Vegas, NV (US)

(72) Inventor: Jared W. Hanlon, Las Vegas, NV (US)

(73) Assignee: Perfect Site, LLC, Las Vegas, NV (US)

( * ) Notice: Subject to any disclaimer, the term of this patent is extended or adjusted under 35 U.S.C. 154(b) by 0 days.

(21) Appl. No.: 18/887,001

(22) Filed: Sep. 16, 2024

(65) Prior Publication Data

US 2025/0113916 A1 Apr. 10, 2025

Related U.S. Application Data

(62) Division of application No. 18/096,699, filed on Jan. 13, 2023, now Pat. No. 12,089,735.

(60) Provisional application No. 63/299,231, filed on Jan. 13, 2022.

(51) Int. Cl.

| | |
|---|---|
| ***A47B 43/00*** | (2006.01) |
| ***A47F 5/10*** | (2006.01) |
| ***A47F 5/13*** | (2006.01) |
| *A47B 47/02* | (2006.01) |

(52) U.S. Cl.

CPC ..... *A47B 43/00* (2013.01); *A47F 5/10* (2013.01); *A47F 5/13* (2013.01); *A47B 47/021* (2013.01)

(58) Field of Classification Search

CPC ..... A47B 43/00; A47B 47/021; A47B 46/00; A47B 47/024; A47B 47/025; A47F 5/10; A47F 5/13; A47F 5/0037; A47F 5/14

See application file for complete search history.

(56) References Cited

U.S. PATENT DOCUMENTS

| | | | | |
|---|---|---|---|---|
| 1,198,431 A * | 9/1916 | Forsyth | A47F 5/13 211/38 |
| 3,093,247 A * | 6/1963 | Erickson | A47B 43/00 211/149 |
| 3,212,605 A * | 10/1965 | Dickerson | E04G 1/34 182/119 |
| 4,740,010 A * | 4/1988 | Moskovitz | A47B 31/04 108/177 |
| 5,806,864 A * | 9/1998 | Zielinski | B62B 3/02 280/42 |

(Continued)

FOREIGN PATENT DOCUMENTS

| | | |
|---|---|---|
| CN | 201324019 | 10/2009 |
| CN | 105193102 | 12/2009 |

(Continued)

*Primary Examiner* — Devin K Barnett
(74) *Attorney, Agent, or Firm* — Snell & Wilmer L.L.P.

(57) ABSTRACT

A collapsible and extendable storage rack is provided. The rack includes a first end support, a second end support, a top shelf hingedly attached to the first end support and selectively connectable to the second end support, a bottom shelf hingedly attached to the second end support and selectively connectable to the first end support, and a middle shelf. The middle shelf includes a first portion and a second portion hingedly connected to the first portion. The first portion is hingedly connected to the first end support. The second portion is hingedly connected to the second end support. The rack is movable between a collapsed position and an extended position.

9 Claims, 8 Drawing Sheets

(56) References Cited

U.S. PATENT DOCUMENTS

| | | | | |
|---|---|---|---|---|
| 6,123,207 | A * | 9/2000 | Mast | B62B 3/025 211/149 |
| 7,389,887 | B2 * | 6/2008 | Liang | A47B 43/00 211/149 |
| RE41,763 | E * | 9/2010 | Ng | A47B 43/00 108/115 |
| 8,256,629 | B2 | 9/2012 | Zhu | |
| 8,256,630 | B2 * | 9/2012 | Zhu | A47B 31/04 211/195 |
| 8,453,854 | B2 * | 6/2013 | Baran | A47F 5/10 211/149 |
| 8,672,147 | B2 * | 3/2014 | Lam | A47F 7/18 211/85.3 |
| 9,060,601 | B2 * | 6/2015 | Landry | A47B 43/00 |
| 9,226,574 | B1 * | 1/2016 | Chen | A47B 96/07 |
| 9,474,368 | B2 | 10/2016 | Frankel et al. | |
| 9,913,533 | B1 * | 3/2018 | Ke | B62B 3/002 |
| 10,058,171 | B2 * | 8/2018 | Deng | A47B 96/021 |
| 10,292,491 | B1 * | 5/2019 | Ke | A47F 5/137 |
| 10,441,070 | B2 * | 10/2019 | Boyer | A47B 3/083 |
| 10,602,838 | B2 * | 3/2020 | Ou | A47B 9/20 |
| 10,604,170 | B1 * | 3/2020 | Davis | B62B 3/008 |
| 11,116,313 | B2 * | 9/2021 | Leung | A47F 5/10 |
| 11,155,289 | B2 * | 10/2021 | You | B62B 3/02 |
| 11,172,759 | B2 * | 11/2021 | Liu | A47B 47/028 |
| 11,208,132 | B2 * | 12/2021 | Chen | B62B 3/025 |
| 11,523,686 | B1 * | 12/2022 | Liu | A47B 96/06 |
| 12,089,735 | B2 | 9/2024 | Hanlon | |
| 2004/0226491 | A1 * | 11/2004 | Chen | A47B 43/00 108/124 |
| 2011/0155680 | A1 * | 6/2011 | Pong | A47B 43/00 211/199 |
| 2011/0253660 | A1 * | 10/2011 | Pong | A47B 43/00 211/198 |
| 2012/0228840 | A1 * | 9/2012 | Qiang | A47B 3/002 280/42 |
| 2016/0066687 | A1 * | 3/2016 | Frankel | A47B 43/00 211/149 |
| 2020/0405050 | A1 * | 12/2020 | Liu | A47B 43/00 |
| 2021/0345771 | A1 * | 11/2021 | Jiang | A47B 31/04 |
| 2021/0378398 | A1 * | 12/2021 | Doherty | A47B 43/00 |
| 2023/0024997 | A1 * | 1/2023 | Hanlon | B62B 3/02 |

FOREIGN PATENT DOCUMENTS

| | | |
|---|---|---|
| CN | 202051220 | 11/2011 |
| CN | 202095814 | 1/2012 |
| CN | 205180769 | 4/2016 |
| JP | 3146007 | 10/2008 |
| KR | 101613689 | 4/2016 |
| KR | 20170000391 | 1/2017 |
| KR | 101747047 | 6/2017 |

* cited by examiner

COLLAPSIBLE AND EXPANDABLE STORAGE RACK

RELATED APPLICATION DATA

This application is a divisional of U.S. application Ser. No. 18/096,699, filed Jan. 13, 2023, which claims priority to U.S. Provisional Application Ser. No. 63/299,231, filed Jan. 13, 2022, which prior applications are incorporated herein by reference in their entireties.

FIELD OF THE INVENTION

The present invention relates to shelving and racks.

BACKGROUND OF THE INVENTION

Various configurations of storage racks exist. Common configurations of storage racks utilize a plurality of vertical support posts which support a plurality of horizontal shelves.

Generally, it is highly desirable to reduce the amount of space occupied by such racks during shipping and storage. For example, in their assembled form, such racks are generally large in dimension. In such a configuration, the racks thus increase the cost of shipping (such as from the manufacturer to a re-seller or directly to a consumer) or storage (such as in the manufacturer's or reseller's warehouse).

To address this problem, many racks are modular. The racks may be constructed from vertical end posts, shelf cross beams and shelf members which are supported on the cross-beams. These elements may be shipped unassembled, thus having a much reduced dimension.

However, this requires that the end user assemble the rack for use. In the case of the average consumer, this process can be frustrating and time consuming. For example, some racks are assembled by joining the various components with a multitude of fasteners, such as bolts (and associated nuts) of different sizes. Further, these fasteners may be lost, mounting holes may not align, etc., all of which makes the assembly process difficult.

An improved storage rack is desired.

SUMMARY OF THE INVENTION

In one aspect of the disclosed concept, a collapsible and extendable storage rack is provided. The rack comprises a first end support; a second end support; a top shelf hingedly attached to the first end support and selectively connectable to the second end support; a bottom shelf hingedly attached to the second end support and selectively connectable to the first end support; and a middle shelf comprising a first portion and a second portion hingedly connected to the first portion. The first portion is hingedly connected to the first end support. The second portion is hingedly connected to the second end support. The rack is movable between a collapsed position in which the middle shelf is folded between the first and second end supports, the top shelf extends along an outside of the first end support generally parallel thereto, and the bottom shelf extends along an outside of the second end support generally parallel thereto, and an extended position in which the first and second end supports are spaced from one another, and the top, middle and bottom shelves extend generally perpendicular to the first and second end supports between the first and second end supports.

In another aspect of the disclosed concept, a method of configuring a storage rack is provided. The method comprises providing the rack with a first end support, a second end support, a top shelf hingedly attached to the first end support and selectively connectable to the second end support, a bottom shelf hingedly attached to the second end support and selectively connectable to the first end support, and a middle shelf comprising a first portion and a second portion hingedly connected to the first portion, the first portion being hingedly connected to the first end support, the second portion being hingedly connected to the second end support; providing the rack in a collapsed position; moving the first end support and the second end support away from each other while unfolding the middle shelf between the first and second end supports; rotating the top shelf into engagement with the second end support; and rotating the bottom shelf into engagement with the first end support in order to move the rack to an extended position.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a storage rack. In one embodiment, the storage rack is movable between collapsed and expanded positions.

Figure 1:
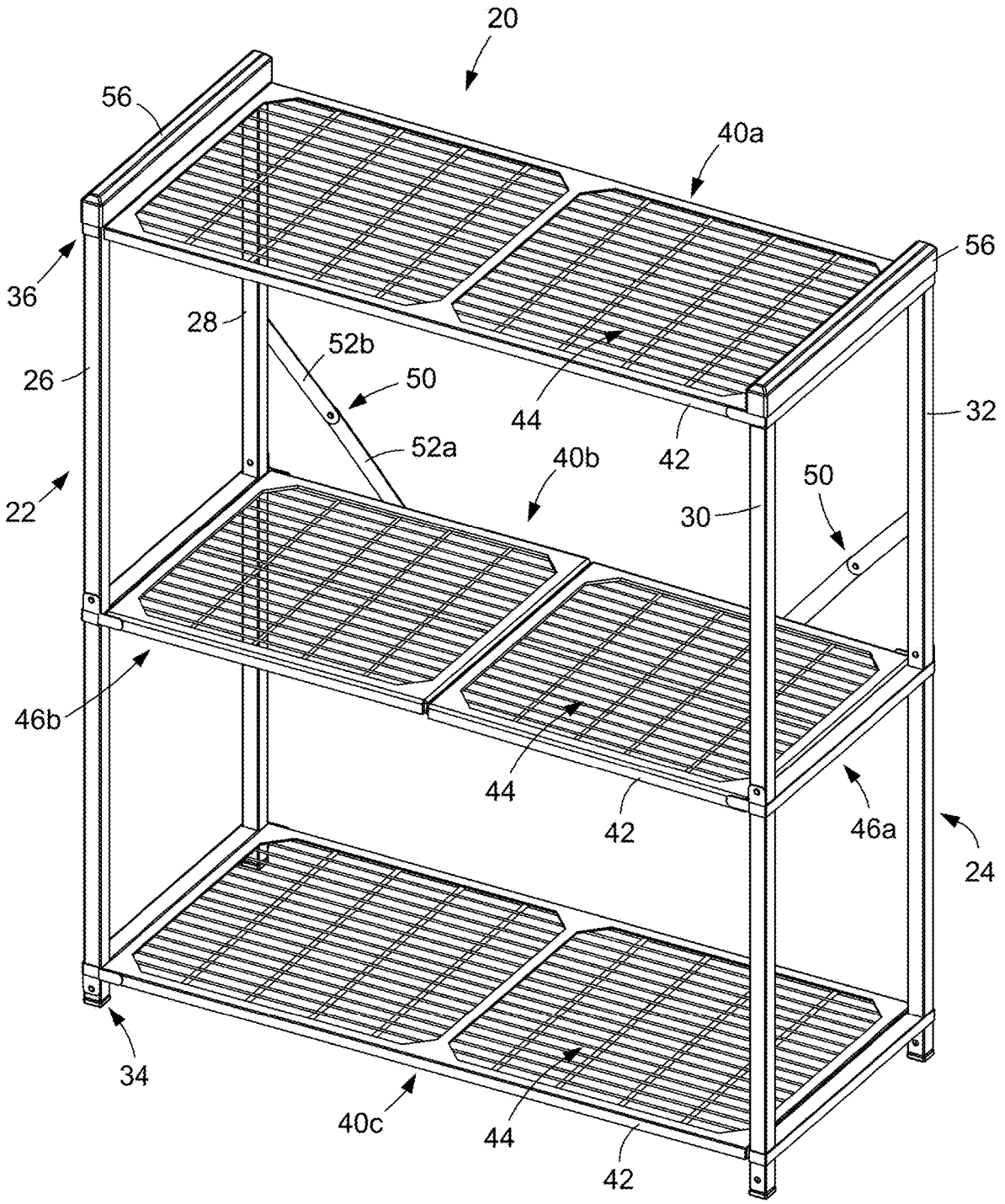
FIG. 1 is a front perspective view of a storage rack in accordance with a first embodiment of the invention.
Figure 2:
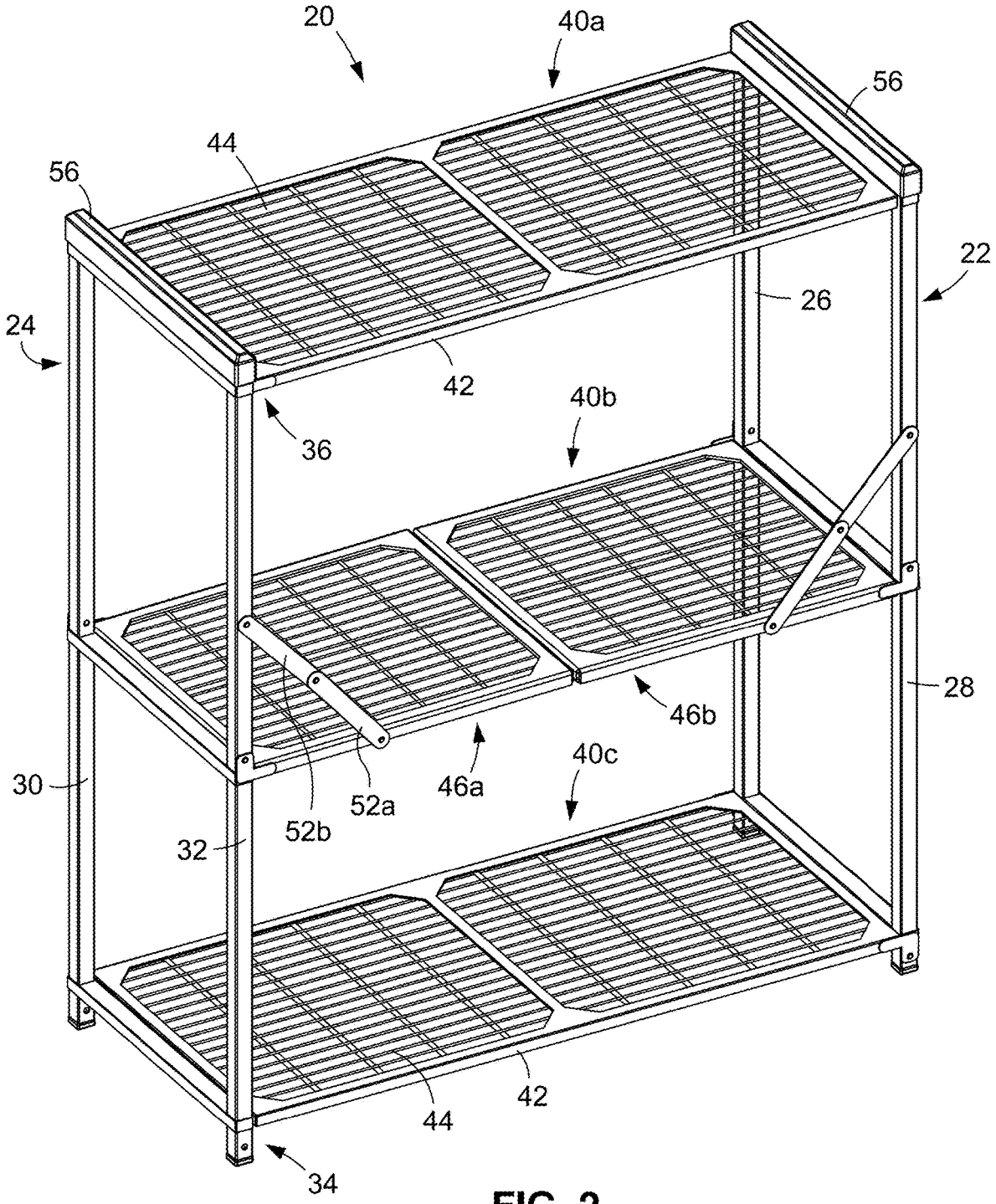
FIG. 2 is a rear perspective view of the storage rack illustrated in FIG. 1.

One embodiment of a storage rack 20 in accordance with the invention is illustrated in FIGS. 1 and 2. The storage rack 20 has a front, an opposing rear, and two opposing ends. In this embodiment, the storage rack 20 includes a first end support 22 at the first end and a second end support 24 at the second end. In one embodiment, the first end support 22 comprises a first or front upright 26 and a second or rear upright 28 and the second end support 24 comprises a first or front upright 30 and a second or rear upright 32. In one embodiment, each upright 26,28,30,32 comprises a post or support and, when the storage rack 20 is configured for use, is generally vertically extending. In such a configuration, each upright 26,28,40,32 has a bottom end 34, such as for engaging a supporting surface, and a generally opposing top end 36.

The storage rack 20 also includes one or more shelves, and preferably at least a first shelf 40*a*, a second shelf 40*b* and a third shelf 40*c*. In the configuration where the storage rack 20 includes three shelves, the first shelf 40*a* may comprise a top shelf (such as positioned near the top of the rack), the second shelf 40*b* may comprise the middle shelf, and the third shelf 40*c* may comprise a lower shelf (such as positioned near a bottom of the rack). As illustrated in FIGS. 1 and 2, when the storage rack 20 is in its use configuration, the shelves 40*a-c* extend between, and are supported by, the end supports 22,24, and the shelves 40*a-c* are generally horizontally extending (and thus extend generally perpendicular to the uprights 26,28,30,32). The shelves 40*a-c* may be generally equidistant apart, or might be spaced by different distances.

Figure 8:
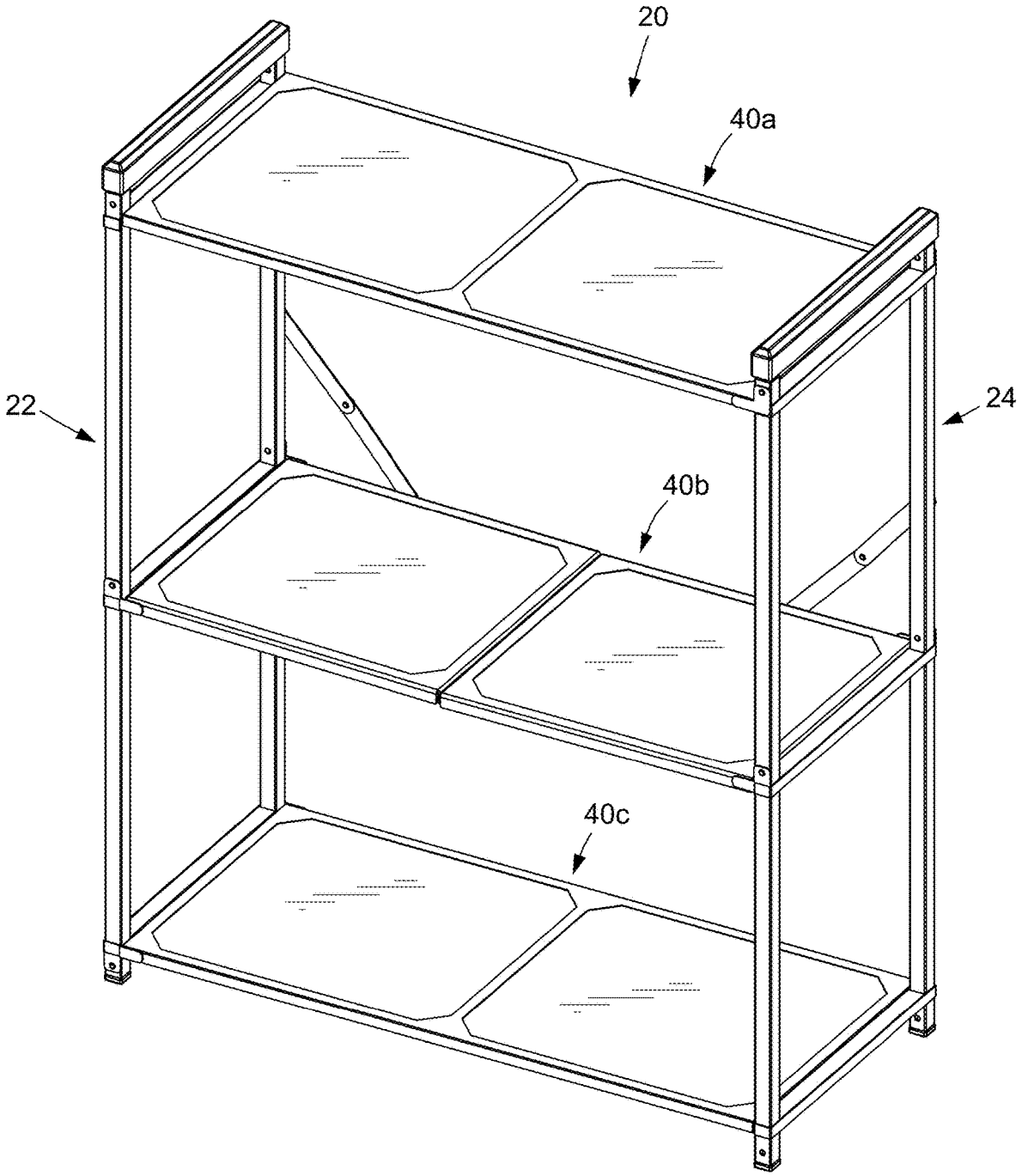
FIG. 8 is a front perspective view of a storage rack in accordance with a second embodiment of the invention.
Figure 9:
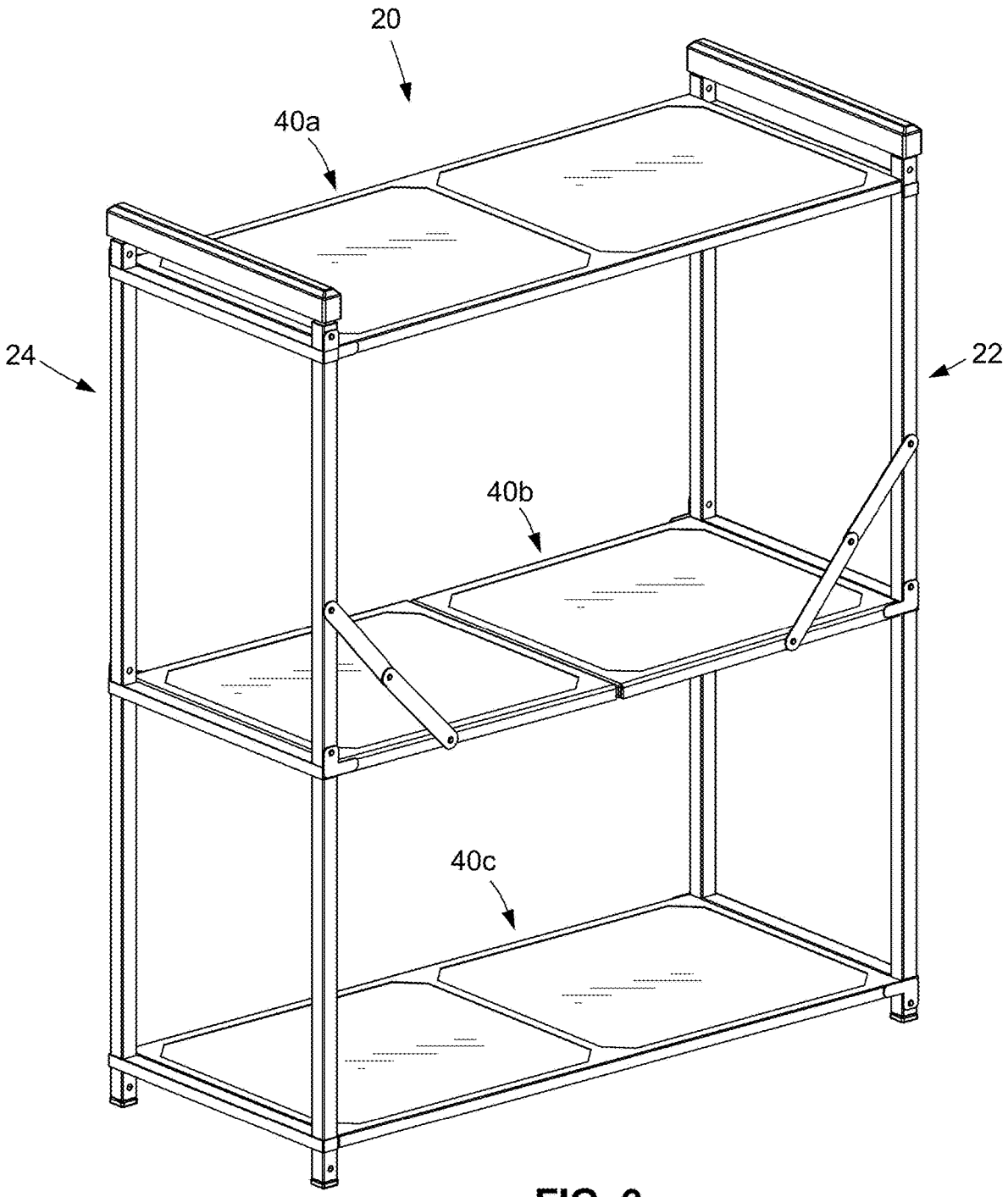
FIG. 9 is a rear perspective view of the storage rack illustrated in FIG. 8.

In one embodiment, the shelves 40*a-c* may comprise a plurality of frame members 42 which support decking 44. The frame members 42 may, for example, define a supporting periphery of the shelves 40*a-c* and/or one or more cross members. The decking 44 may comprise, for example, wire mesh panels such as illustrated in FIGS. 1 and 2, or closed decking (such as metal or plastic sheets) as illustrated in FIGS. 8 and 9. The decking 44 may be connected to the frame members 42 in various manners, such as welding, by fasteners or the like. In some embodiments, the decking 44 may be removable, while in a preferred embodiment, the decking is permanently attached.

In a preferred embodiment of the invention, the storage rack 20 is collapsible and expandable, wherein in its collapsed position, it occupies a significantly smaller volume/space than in its expanded position. In one embodiment, the storage rack 20 is movable between: 1) an expanded position in which the uprights 26,28,30,32 are generally vertically extending and the shelves 40*a-c* are generally horizontally extending between the first and second end supports 22,24, whereby the end supports 22,24 are separated by a length of the shelves, such as illustrated in FIGS. 1-2, and 2) a collapsed position in which the end supports 22,24 are positioned adjacent to one another and the shelves 40*a-c* extend generally parallel to the uprights 26,28,30,32, as best illustrated in FIG. 3.

Figure 3:
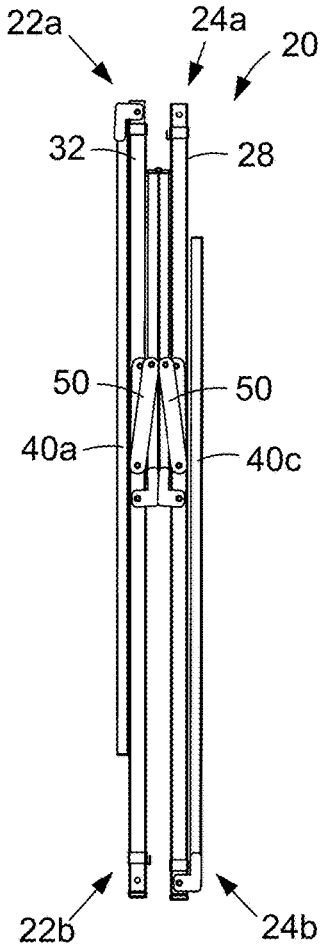
FIG. 3 illustrates the storage rack of FIG. 1 in a collapsed position.

Moreover, as shown in FIG. 3, the first and second end supports 22,24 each include a first end 22*a*,22*b* and a second end 22*b*,24*b* located opposite the first end 22*a*,22*b*. When the rack 20 is in the collapsed position (FIG. 3), the first end 22*a* of the first end support 22 is located proximate the first end 24*a* of the second end support 24, the second end 22*b* of the first end support 22 is located proximate the second end 24*b* of the second end support 24, the top shelf 40*a* extends from the first end 22*a* of the first end support 22 toward the second end 22*b* of the first end support 22, and the bottom shelf 40*c* extends from the second end 24*b* of the second end support 24 toward the first end 24*a* of the second end support 24.

In one embodiment, movement of the storage rack 20 between its collapsed and expanded position is facilitated by hinged or rotating connection of the shelves 40*a-c* to the first and/or second end supports 22,24, thus permitting the shelves 40*a-c* to be moved from a position in which they extend outwardly generally perpendicular thereto, to a position in which they extend generally parallel thereto.

Figure 4A:
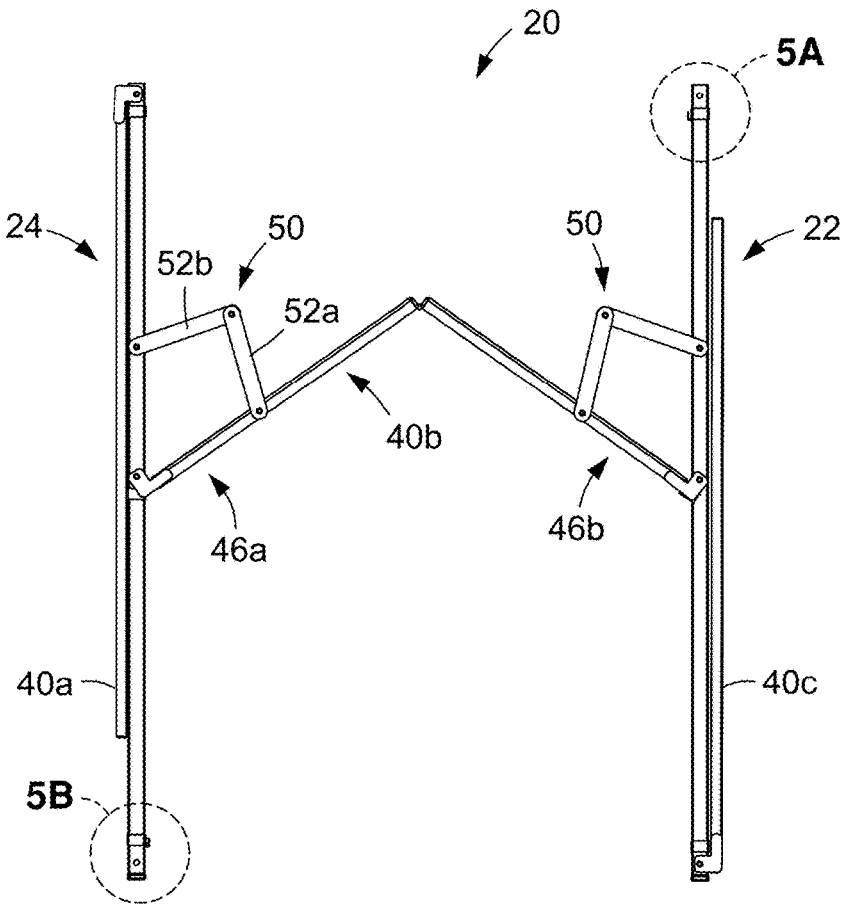
FIGS. 4A and 4B are side and perspective views illustrating the storage rack of FIG. 3 in a partially expanded position.
Figure 4B:
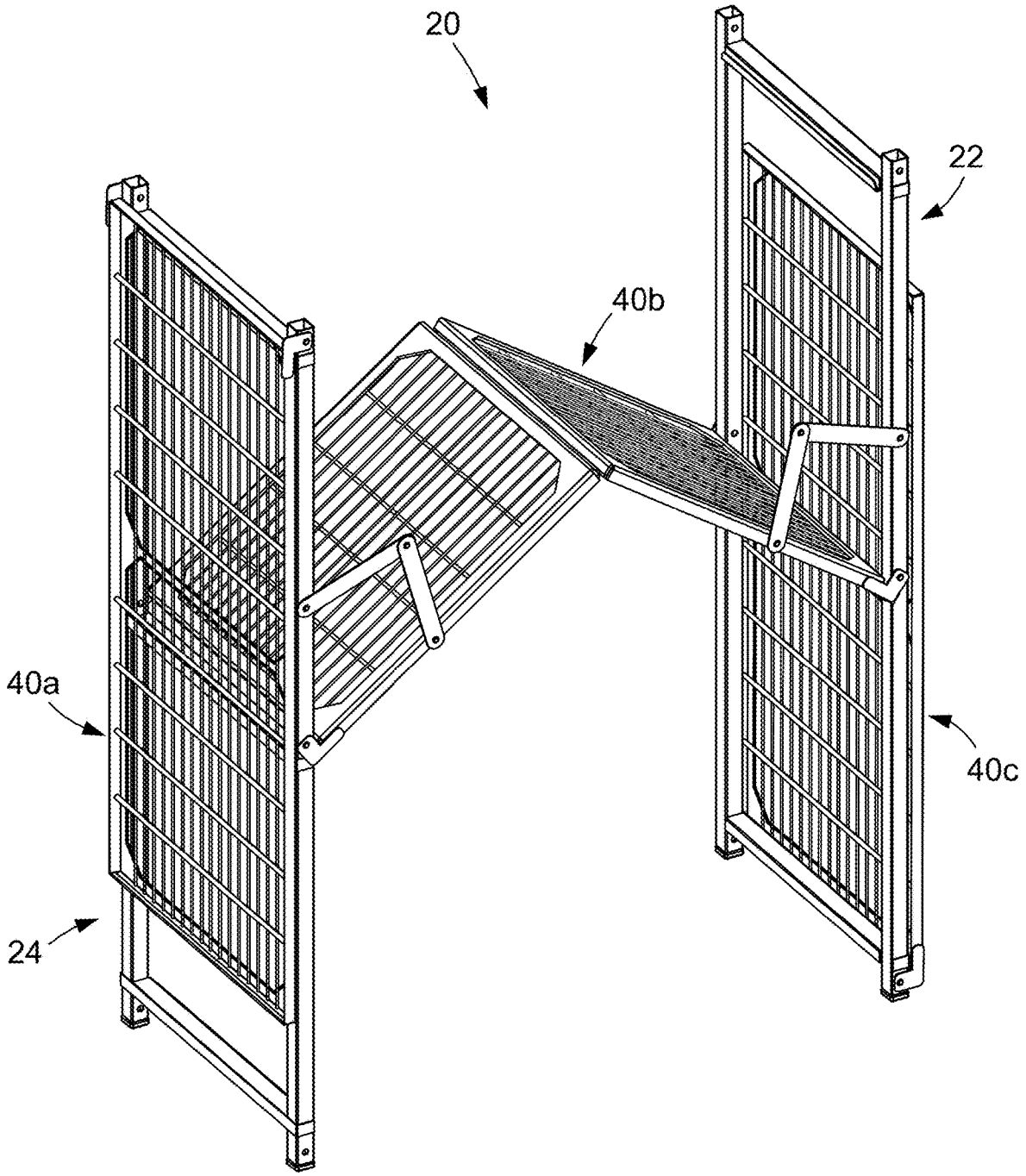
Figure 6A:
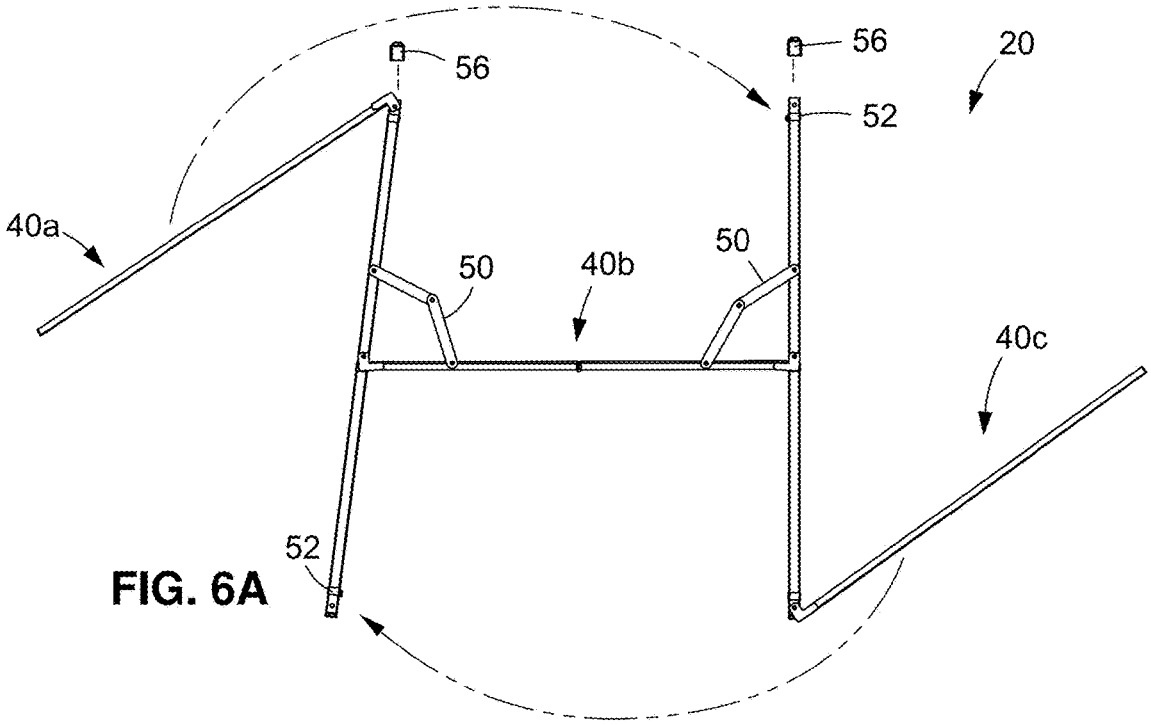
FIGS. 6A and 6B are side and perspective views illustrating the storage rack of FIG. 4A in a further expanded position.
Figure 6B:
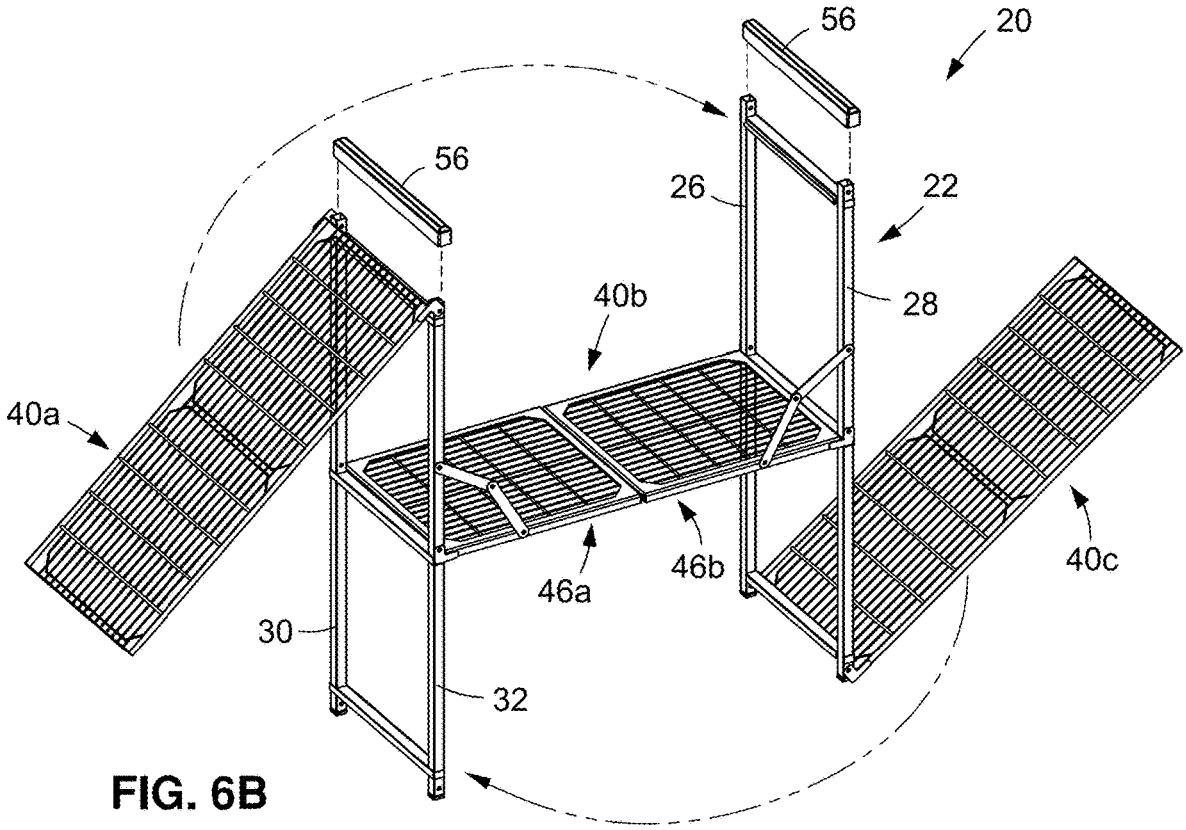
Figure 7A:
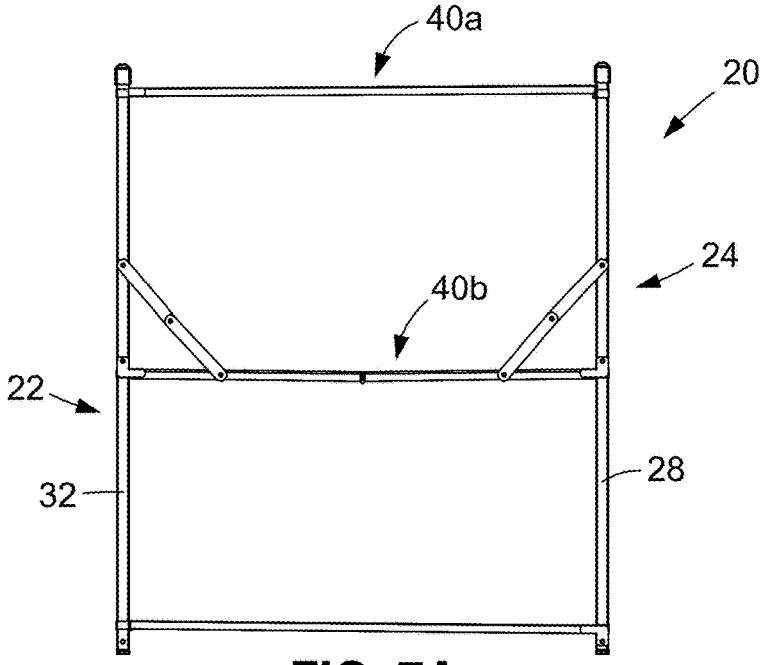
FIGS. 7A and 7B are side and perspective views illustrating the storage rack of FIG. 4A in a fully expanded position.
Figure 7B:
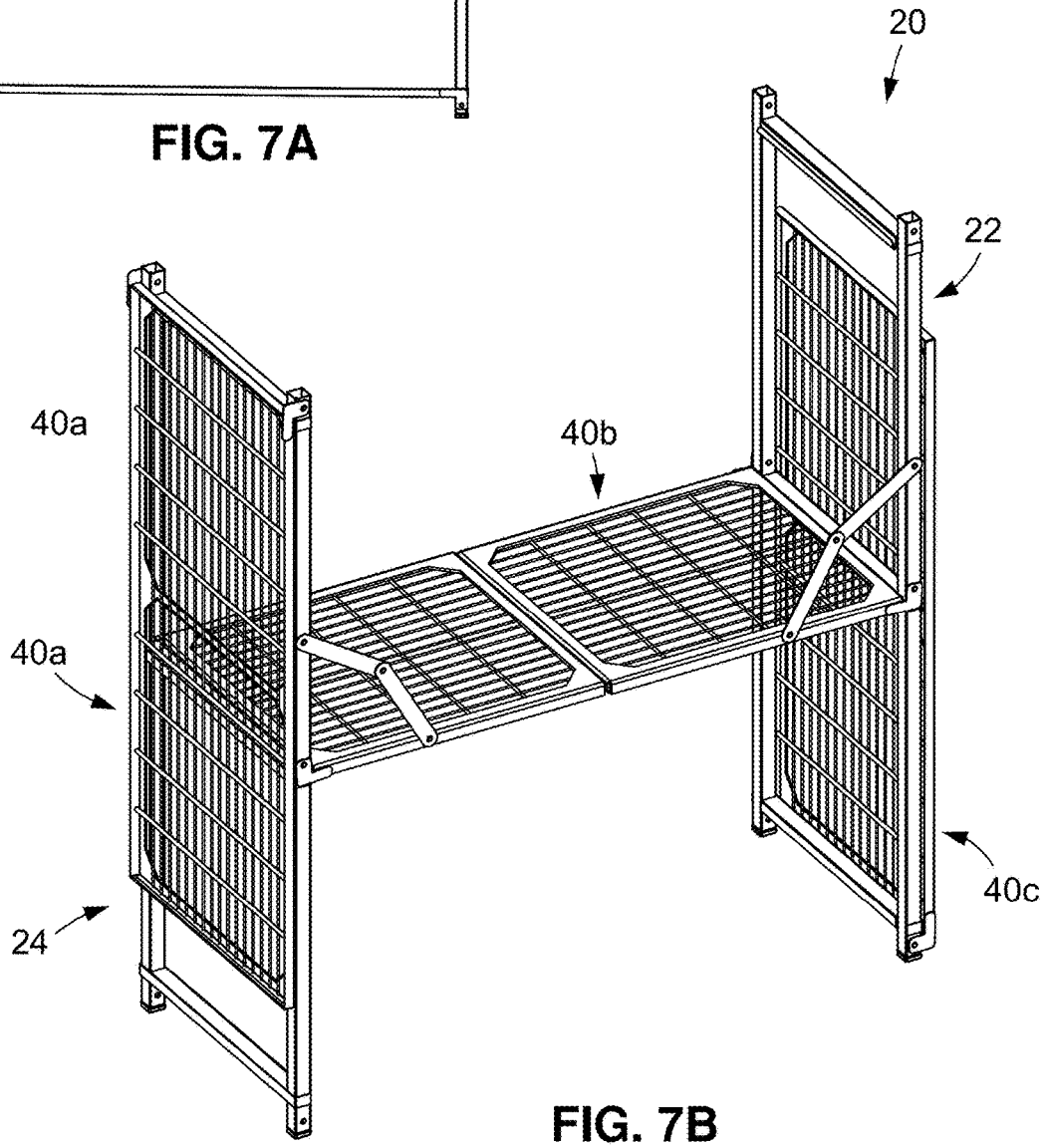

As illustrated in FIGS. 6A and 6B, the top shelf 40*a* may be rotatably connected to the second end support 24, such as by hinges connecting the shelf 40*a* to the first and second uprights 30,32 of the second end support 24. This allows the top shelf 40*a* to be rotated (or "swing") from a position in which it extends generally parallel to the second end support 24 exterior thereto, as illustrated in FIGS. 4A and 4B, to a position in which it extends generally perpendicular to the second end support 24 towards the first end support 22, as illustrated in FIGS. 7A and 7B.

Similarly, as illustrated in FIGS. 6A and 6B, the bottom shelf 40*c* may be rotatably connected to the first end support 22, such as by hinges connecting the shelf 40*c* to the first and second uprights 26,28 of the first end support 22. This allows the bottom shelf 40*b* to be rotated (or "swing") from a position in which it extends generally parallel to the first end support 22 exterior thereto, as illustrated in FIGS. 4A and 4B to a position in which it extends generally perpendicular to the first end support 22 towards the second end support 24, as illustrated in FIGS. 7A and 7B.

The middle shelf 40*b* is also rotatably connected to the first and/or second end supports 22,24. In a preferred embodiment, the middle shelf 40*b* is rotatably connected to both the first and second end supports 22,24, and itself has first and second portions 46*a,b* which are hingedly or rotatably connected. As illustrated in FIGS. 4A and 4B, the first portion 46*a* of the middle shelf 40*b* is rotatably connected to the second end support 24, while the second portion 46*b* of the middle shelf 40*b* is rotatably connected to the first end support 22. Further, the first and second portions 46*a,b* of the middle shelf 40*b* are themselves hingedly or rotatably connected to one another This allows the middle shelf 40*b* to be rotated from a position in which the first portion 46*a* extends generally parallel to the second end support 24 at the inside thereof and in which the second portion 46*b* extends generally parallel to the first end support 22 at the inside thereof, as illustrated in FIG. 3, to a position in which the first and second portions 46*a,b* extend generally perpendicular to the first and second end supports 22,24, as illustrated in FIGS. 7A and 7B. In this regard, the middle shelf 40*b* may be referred to as a "folding" shelf.

In one embodiment, one or more secondary supports 50 may be provided to add support to the middle shelf 40*b* in its extended position, such as to prevent high loading from causing a failure of the hinged connection of the first and second portions 46*a,b* to one another. As illustrated in FIGS. 4A and 4B, the secondary supports 50 may be configured as scissor arms having first and second arm portions 52*a,b* which are hingedly or rotatably connected to one another and the respective second end support 24 and first portion 46*a* and the first end support 22 and the second portion 46*b*. As illustrated, the secondary supports 50 might be located at a rear of the rack 20, such as to avoid interference with use of or access to the rack from the front.

Additional details of the storage rack 20 will now be described in conjunction with a description of the operation thereof. As illustrated in FIG. 3, the rack 20 may be stored in a collapsed position, such as for transport/shipping, storage, etc. In this position, the first and second end supports 22,24 are located adjacent to one another. The top shelf 40*a* extends along the outside of the second end support 24, generally parallel thereto. The bottom shelf 40*c* extends along the outside of the first end support 22, generally parallel thereto. The middle shelf 40*b* is folded, such that the first portion 46*a* extends along the inside of the second end support 24 and the second portion 46*b* extends along the inside of the first end support 22, whereby the middle shelf 40*b* is folded between the first and second end supports 22,24.

Figure 5A:
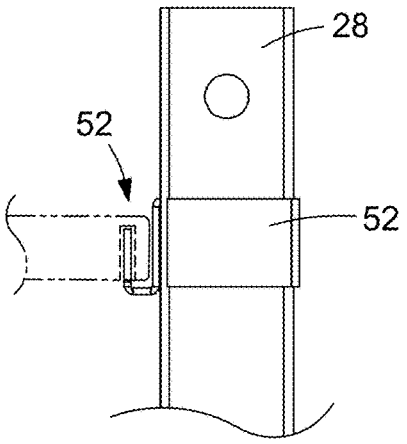
FIGS. 5A and 5B are enlarged portions of the storage rack indicated in FIG. 4A.

As illustrated in FIGS. 4A-B and 7A-B, the first and second end supports 22,24 may be moved away from one another, unfolding the middle shelf 40*b*. Once the middle shelf 40*b* is substantially unfolded or extended, as illustrated in FIGS. 6A and 6B, the top shelf 40*a* may be rotated towards the first end support 22 and is connected thereto. As illustrated in FIG. 5A, a bracket 52 may be associated with the second end support 24, such as either or both the first and second uprights 30,32 thereof (or extending therebetween). The bracket 52 may comprise an elongate "U" shaped element which defines a channel 54 for accepting a mating portion of the top shelf 40*a* therein. The channel 54 may extend or face upwardly, whereby the top shelf 40*a* may be rotated downwardly into the channel 54, with the bracket 52 limiting further downward movement of the top shelf 40*a* beyond horizontal.

Figure 5B:
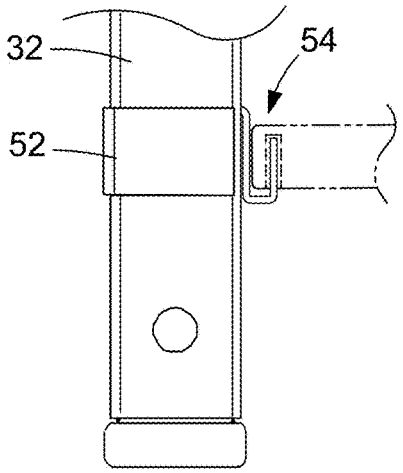

Likewise, the bottom shelf 40*c* may be rotated towards the second end support 24 and be connected thereto. As illustrated in FIG. 5B, another bracket 52 may be associated with the first end support 22, such as either or both the first and second uprights 26,28 thereof (or extending therebetween). The bottom shelf 40*c* may thus be rotated past the bracket 52 (such as by slightly tilting the first end support 22 outwards, as illustrated in FIG. 6A, and then back downwardly so that it engages the channel in the bracket 52. Accordingly, when the rack moves from the collapsed position toward the extended position, the second end support 24 is tilted outwards and then back inwards, with respect to the first end support 22, in order to allow the bottom shelf 40*c* to engage the bracket 52.

Additionally, as best shown in FIG. 6A, it will be appreciated that when the rack 20 moves from the collapsed position toward the extended position, the top shelf 40*a* rotates in a clockwise direction with respect to the first end support, and the bottom shelf 40*c* rotates in a clockwise direction with respect to the second end support.

As illustrated in FIGS. 6A and 6B, a cap 56 may be placed on the first and second end supports 22,24 once the top shelf 40*a* has been rotated into position. The top cap 56 may, for example, comprise an elongate member with one or more openings for accepting the first and second uprights of the first and second supports 22,24. Additionally, in one example the top caps 56 are each detachably connected to a corresponding one of the first and second end supports 22,24 in order to allow the top shelf 40*a* to move from the collapsed position to the extended position. Furthermore, it will be appreciated that a storage rack 20 which is in its extended position may be moved back to its retracted position by reversing the process described above.

As indicated above, the shelves 40*a-c* may have various configurations. FIGS. 8 and 9 illustrate a configuration in which the panels are solid or closed, as opposed to comprising wire mesh.

In the embodiment illustrated, the storage rack 20 has three shelves, wherein the top and bottom shelves are "swing" shelves, and the middle rack is a "folding" shelf. This configuration has a number of significant advantages, including that the middle rack serves to permanently join the end supports and the top and bottom shelves are then used to lock the top and bottom ends of the end supports into rigid positions, enhancing the rigidity/strength of the rack 20 during use.

In some embodiments, however, the rack 20 might have other numbers of shelves, such as a lower folding shelf and a single upper swing shelf, a lower swing shelf and an upper folding shelf, or multiple upper and/or lower swing shelves (such as if the height of the rack 20 is greatly increased).

In one embodiment, the middle or folding shelf 40*b* is split into portions 46*a,b* which are generally of equal size. In other embodiments, the two portions might have different sizes/dimensions.

In one embodiment, the shelves 40*a-c* may be connected to the end supports 22,24 (and particularly the uprights 26,28,30,32) via rotatable connectors, such as via or about a pin. The portions 46*a,b* of the middle folding shelf 40*b* may be connected by one or more hinges or the like. However, other types of mounts or mountings might be utilized which permits movement of the shelves or shelf portions as described herein.

In one embodiment, the uprights of the end supports 22,24 are single members, but in other embodiments, they might comprise more than one member, such as joined or joinable by one or more connectors. Further, while the end supports 22,24 may comprise two uprights, they might comprise three or more uprights.

The components of the storage rack 20 may be constructed from various materials. For example, the end support uprights, shelf frame members and the like may be constructed from metal, such as metal tubing or the like. In some cases, members may be painted, coated or the like.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A method of configuring a storage rack comprising:

providing the rack with a first end support, a second end support, a top shelf hingedly attached to the first end support and selectively connectable to the second end support, a bottom shelf hingedly attached to the second end support and selectively connectable to the first end support, and a middle shelf comprising a first portion and a second portion hingedly connected to the first portion, the first portion being hingedly connected to the first end support, the second portion being hingedly connected to the second end support;

providing the rack in a collapsed position;

moving the first end support and the second end support away from each other while unfolding the middle shelf between the first and second end supports;

rotating the top shelf into engagement with the second end support; and rotating the bottom shelf into engagement with the first end support in order to move the rack to an extended position.

2. The method according to claim 1, wherein the rack further comprises a first secondary support and a second secondary support, wherein the first secondary support is connected to the first end support and the first portion of the middle shelf, and wherein the second secondary support is connected to the second end support and the second portion of the middle shelf.

3. The method according to claim 2, wherein the first secondary support and the second secondary support are each configured as scissor arms having first and second arm portions which are hingedly connected to one another.

4. The method according to claim 3, wherein the top shelf, the bottom shelf, and the middle shelf each comprise a wire mesh panel.

5. The method according to claim 1, wherein the rack further comprises a first bracket and a second bracket each associated with a corresponding one of the first end support and the second end support, wherein rotating the top shelf comprises limiting downward movement of the top shelf toward the middle shelf, and wherein rotating the bottom shelf comprises engaging the second bracket with the bottom shelf.

6. The method according to claim 5, wherein rotating the bottom shelf comprises tilting the second end support outwards and then back inwards, with respect to the first end support, in order to allow the bottom shelf to engage the second bracket.

7. The method according to claim 6, wherein rotating the top shelf comprises rotating the top shelf in a clockwise direction with respect to the first end support, and wherein rotating the bottom shelf comprises rotating the bottom shelf in a clockwise direction with respect to the second end support.

8. The method according to claim 7, wherein the first end support and the second end support each comprise a first end and a second end disposed opposite the first end, and wherein providing the rack in the collapsed position comprises:

disposing the first end of the first end support proximate the first end of the second end support, disposing the second end of the first end support proximate the second end of the second end support, extending the top shelf from the first end of the first end support toward the second end of the first end support, and extending the bottom shelf from the second end of the second end support toward the first end of the second end support.

9. The method according to claim 1, wherein the rack further comprises a first cap and a second cap, wherein the first end support and the second end support each comprise first and second uprights, wherein the first cap and the second cap each comprise an elongate member with a first opening and a second opening for accepting the first and second uprights of the first and second end supports, and wherein the first cap and the second cap are each detachably connected to a corresponding one of the first and second end supports in order to allow the top shelf to move from the collapsed position to the extended position.

* * * * *